United States Patent [19]

Hildebrandt et al.

[11] 4,242,607

[45] Dec. 30, 1980

[54] CENTRIFUGAL ACTUATOR FOR MOTOR STARTING SWITCH

[75] Inventors: Eugene F. Hildebrandt, Ferguson; William D. Crow, St. Louis, both of Mo.

[73] Assignee: Emerson Electric Co., St. Louis, Mo.

[21] Appl. No.: 14,844

[22] Filed: Feb. 26, 1979

[51] Int. Cl.[3] ..... H01H 35/10

[52] U.S. Cl. ..... 310/68 E; 200/80 R; 73/538

[58] Field of Search ..... 200/80 R, 153 R, 153 V, 200/153 SC; 318/462, 793; 310/68 E; 73/538, 550

[56] References Cited

U.S. PATENT DOCUMENTS

| | | | |
|---|---|---|---|
| 2,372,064 | 3/1945 | Esarey | 318/793 |
| 2,747,854 | 5/1956 | Schnepf | 200/80 R |
| 2,863,962 | 12/1958 | Letteney | 200/80 R |
| 3,271,602 | 9/1966 | Waters | 310/68 R |
| 3,609,421 | 9/1971 | Hildebrandt | 310/68 E |
| 3,790,730 | 2/1974 | Wyland | 318/793 |

*Primary Examiner*—Gerald P. Tolin

*Attorney, Agent, or Firm*—Polster, Polster and Lucchesi

[57] ABSTRACT

A centrifugal actuator assembly for an electric motor or the like is provided having a pair of opposed movable members rotatable with the rotor shaft of the motor and responsive to centrifugal force upon rotation of the rotor shaft for movement between a run and a start position. The movable members are biased inwardly toward their start position by means of compression coil springs interconnected between the movable members by means of a linkage designed to improve operating life of the centrifugal actuator.

6 Claims, 7 Drawing Figures

CENTRIFUGAL ACTUATOR FOR MOTOR STARTING SWITCH

BACKGROUND OF THE INVENTION

This invention relates to a centrifugal actuator assembly and more particularly to a centrifugal actuator assembly for actuating a starting switch on an AC electric motor in response to the operating speed of the motor.

In many conventional electric motors, such as single phase induction motors, a rotating magnetic field is produced by means of a main winding and a starting winding included within the stator assembly of the motor. These windings are so designed and arranged within the stator that upon start up of the motor, sufficient starting torque is attained. Once the motor reaches a predetermined operational speed, a switch (referred to as a starting switch) is opened thereby to deenergize the starting winding by means of some device responsive to the rotational speed of the motor. Upon the motor slowing below another predetermined speed of operation (e.g., upon stopping), the starting switch is closed so that upon the motor being again energized the starting winding will also be energized so as to generate sufficient torque for starting purposes. The starting switch conventionally is operated by a centrifugal actuator rotatable with the rotor shaft of the motor, the centrifugal actuator being responsive to the speed at which the motor (i.e., the rotor shaft of the motor) is rotated.

As shown in U.S. Pat. No. 3,271,602 and 3,609,421, prior art centrifugal actuators were rotatable with a rotor shaft and included a centrifugal weight assembly. The latter included a pair of centrifugal levers pivotally mounted on the shaft and were rotatable therewith with the levers carrying a weight on their outer or free ends. Upon the shaft rotating at a predetermined speed, the weights are thrown outwardly by centrifugal force thus causing the levers to pivot which in turn effects axial shifting movement of a portion of the centrifugal actuator with respect to the rotor shaft. This axial movement of a portion of the centrifugal actuator assembly in one direction from a so-called starting position to a run position upon acceleration of the motor to its predetermined operational speed effects the opening of the starting switch through the operation of an appropriate linkage or the like. Typically, the centrifugal levers are resiliently biased inwardly toward the shaft and toward their starting position by means of extension springs. As the centrifugal actuator assembly is rotated to its desired predetermined operational speed, the centrifugal levers must overcome the bias of the extension springs to move outwardly from their starting to their run positions. Upon slowing of the motor, the extension springs bias the levers inwardly and effect axial movement of a portion of a centrifugal actuator assembly from its run position to its starting position which in turn closes the starting switch.

Typically, the extension springs used to bias the centrifugal levers inwardly toward their starting positions are conventionally wound wire extension springs having hook-type ends for connection between the opposed centrifugal levers and for transferring the load of the spring to the centrifugal levers. However, these hook ends on the extension springs introduce a relatively high stress concentration factors into the springs and, on occasion, have lead to the premature failure (breakage) of the spring. A broken spring in a centrifugal actuator assembly would, in some instances, prevent the motor from starting either due to premature deenergization of the starting winding or due to failure of the centrifugal actuator to close the starting switch upon shut down of the motor. Also, the centrifugal actuator levers are normally restrained on the actuator by the springs and in the event of a spring failure, the levers oftentimes are flung outwardly and are thrown into the stator windings shorting them and causing failure of the motor. Still further, pieces of the broken spring could work their way into the windings of the motor and cause an electrical failure of the motor.

Also, extension springs resulted in a non-linear application of biasing force on the centrifugal actuators. Typically, the coils of an extension spring are closely wound in their relaxed or unloaded position so that an initial load, referred to as initial tension, must be applied to the spring to separate its closely packed turns. This initial tension is usually specified to be present in extension springs so that the spring will accurately hold its free length. However, once the initial tension of the spring has been overcome, the spring will then linearly extend in such manner as is indicated by the spring constant for the spring. In effect then, extension springs have two different spring constants, one which is in effect until the initial tension of the spring has been overcome and the other of which is in effect during the remainder of the extension of the spring. Also, in certain conditions, extension springs may be overstressed thus permanently deforming them and permanently altering the force applied to the centrifugal actuator by the springs which in turn alters the centrifugal force (and the rotational speed of the rotor shaft) required to open the starting switch.

SUMMARY OF THE INVENTION

Among the several objects and features of this invention may be noted the provision of a centrifugal actuator for actuating a starting switch in which failures of the resilient members due to stress concentration have been eliminated thus significantly increasing the service life and reliability of the centrifugal actuator;

The provision of such a centrifugal actuator assembly in which the resilient members biasing the levers of the centrifugal actuator toward their starting position cannot be inadvertently overstressed;

The provision of such a centrifugal actuator assembly which utilizes one or more compression springs for biasing the centrifugal levers of the centrifugal actuator toward their starting positions;

The provision of such a centrifugal actuator assembly in which its centrifugal levers are linearly biased toward their starting positions;

The provision of such a centrifugal actuator assembly which, in the unlikely event of failure of a spring, does not result in damage to the motor;

The provision of such a centrifugal actuator assembly which is easy and inexpensive to manufacture; and The provision of such a centrifugal actuator assembly which increases the service life and reliability of an electric motor in which it is installed.

Briefly, a centrifugal actuator assembly of the present invention is intended for use with an electric motor, such as a split-phase motor, having a starting winding and a starting switch for selectively energizing and deenergizing a starting winding. The centrifugal actuator assembly of this invention is rotatable with the rotor shaft of the motor and has a pair of movable members (or levers) on opposite sides of the rotor shaft centrifugally responsive to the rotation of the rotor shaft for moving outwardly from a starting position to a run position upon rotation of the rotor shaft at a predetermined operating speed. The centrifugal actuator assembly also includes means for resiliently biasing the movable members toward their starting position, the movable members being movable from their run to their starting positions upon a reduction in motor speed. The centrifugal actuator assembly is adapted to be operatively interconnected to the starting switch so as to effect closing and opening of the starting switch as the centrifugal actuator moves between its corresponding starting and run positions. In particular, the improvement of this invention involves a pair of compression springs and a pair of linkages, one for each of the compression springs, interconnecting the springs between the movable members (or levers) with the compression springs and the linkages constituting the above-noted resilient bearing means. Each of the linkages comprises a first element engageable with one end of its respective compression spring and with the movable member (lever) opposite the above-noted one end of its compression spring and a second element engageable with the other end of the compression spring and interconnected with the other movable member (lever) so that upon said movable members moving outwardly from their starting positions to their run positions the first and second members elements move relative to one another so as to resiliently compress their respective springs therebetween.

Other objects and features of this invention will be in part pointed out and in part apparent hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
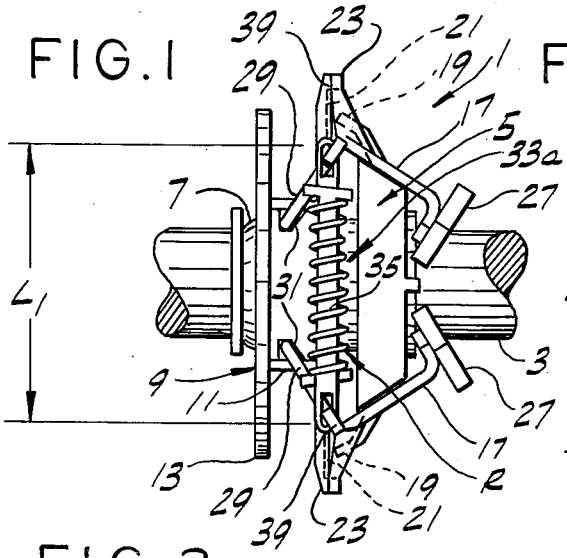
FIG. 1 is a side elevational view of a centrifugal actuator of the present invention installed on the rotor shaft of an electric motor, the centrifugal actuator assembly being shown in its starting postion.

Referring now to the drawings, a centrifugal actuator assembly of this invention is shown in its entirety by reference character 1 and is further shown to be mounted on a rotor shaft 3 of an electric motor or the like for rotation with the shaft. This centrifugal actuator assembly is broadly similar to the centrifugal actuator assembly disclosed in the co-assigned U.S. Pat. No. 3,609,421 invented by one of the co-inventors, Eugene F. Hildebrandt, of the present invention. As described in the above-noted prior U.S. patent, centrifugal actuators are used in conjunction with a motor starting switch in various induction A.C. motors for the energization of a starting or auxiliary winding included within the stator of the motor upon startup of the motor and for switching out the auxiliary winding after the motor has accelerated to a predetermined speed. Such use of centrifugal actuators is old and for that reason is not shown per se herein. If further details are needed, reference may be made to the above-noted patent.

Figure 2:
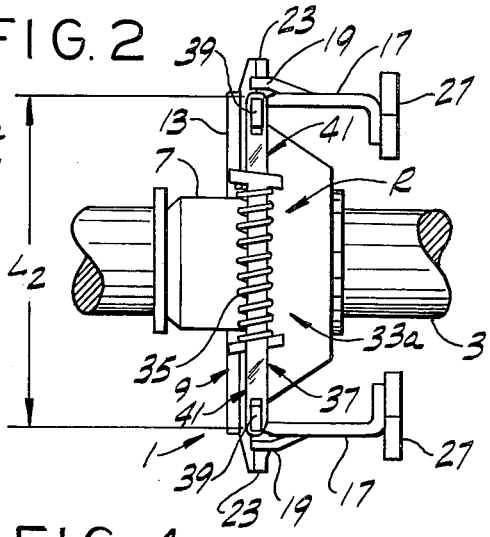
FIG. 2 is a view similar to FIG. 1 illustrating the centrifugal actuator in its run position.
Figure 3:
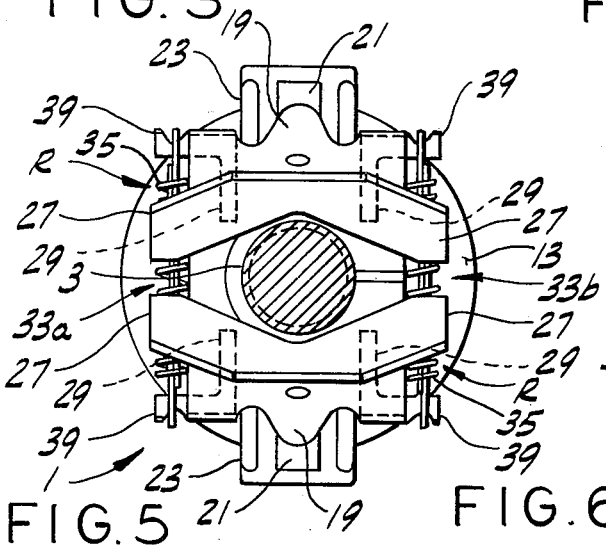
FIG. 3 is a right end elevational view of the centrifugal actuator as it is shown in FIG. 1.
Figure 4:
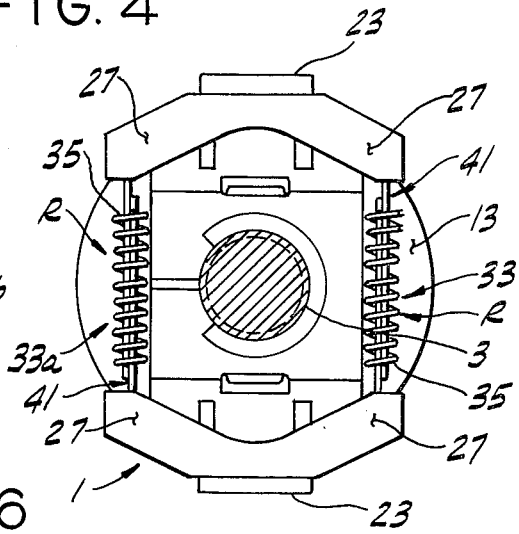
FIG. 4 is a right end elevational view of the centrifugal actuator as it is shown in FIG. 2.

Centrifugal actuator assembly 1 includes a main body 5 having a sleeve portion 7 mounted for rotation on rotor shaft 3. Slidably mounted on sleeve portion 7 is a member 9 for engaging a linkage (not shown) which in turn is operatively connected to a motor starting switch (also not shown). Member 9 has a sleeve portion 11 and a large diameter circular flange 13 at one end thereof adapted to engage the above-mentioned switch operating linkage. The switch engaging member 9 is movable axially relative to main body 5 (i.e., toward the left as it is viewed in FIG. 1) by a pair of movable, opposed levers 17 (also referred to as movable members) located on opposite sides of main body 5 and on opposite sides of shaft 3. Each lever 17 has a projection 19 which is received in a respective slot 21 formed in opposite radially outwardly projecting portions 23 of main body 5. Levers 17 are each pivoted on the main body for pivotal movement about lever projections 21 between a first or starting position (as shown in FIGS. 1 and 3) and a second or run position (as shown in FIGS. 2 and 4) and are responsive to centrifugal force upon rotation of shaft 3.

A weighted element 27 is carried on the outer or free ends of each lever 17, and the other end of each lever 17 is bifurcated having a pair of end portions 29 entered into notches 31 formed in the exterior surface of the slidably mounted switch engaging member 9. The bifurcated end portions 29 of levers 17 straddle the radially outwardly extending portions 23 of main body 5 at their ends, with portions 29 entering notches 31 which are so arranged at the corners of a right angle parallelogram circumscribing body sleeve 11. Switch engaging member 9 and main body member 5 are thereby caused to shift in axial direction on sleeve 7 in response to rotation of shaft 3 which in turn causes centrifugal force to rotate levers 17 from their starting to their run positions. Upon slowing or stopping of the motor, the centrifugal force exerted on the weights 27 will decrease and resilient means as generally indicated at R, act to return the levers to their starting positions. A more complete description of the structural details of centrifugal actuator 1 may be had by referring to the above-noted U.S. Pat. No. 3,609,421.

Resilient means R includes a pair of spring assemblies, as generally indicated at 33*a*, 33*b*, interconnected between the pair of opposed levers 17 on opposite sides of shaft 3. Each spring assembly includes a compression coil spring 35 and a spring compression linkage, as generally indicated at 37, which is adapted to be operatively connected to attachment ears 39 provided on levers 17. Compression coil spring 35 is preferably a plain-end wound wire spring in which the turns of the spring are normally spaced apart when the spring is unloaded. When the centrifugal actuator is in its starting position as shown in FIG. 1, spring 35 has a substantially unloaded length $1_l$ (see FIG. 5) which is preferably only somewhat less than its free length in which the turns or coil of the spring are spaced apart, and the overall length of resilient means R is indicated by dimension $L_1$. Spring 35 has an axial opening therethrough. As shown in FIGS. 1–6, compression linkage 37 is comprised of two generally T-shaped members or elements 41 each made of stamped sheet metal or the like having a head 43 and a shank or stem 45. T-shaped members or elements 41 are turned opposite one another so that the head of one of the elements is disposed adjacent the free end of the shank of the other of the elements. The T-shaped elements are arranged so as to be in face-to-face overlapping sliding relation with one another. Each shank 45 has an opening 47 therein at its outer end for reception of a respective ear 39 on lever 17. Shanks 45 of the pair of T-shaped elements constituting a linkage 37 are disposed within the central opening of a respective spring 35 (i.e., the spring surrounds the shanks). Heads 43 of the T-shaped elements bear against opposite ends of their respective spring 35.

Figure 5:
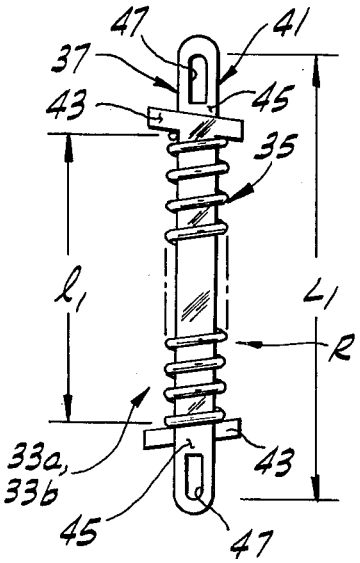
FIG. 5 is a side elevational view of an improved resilient means of this invention as it would appear when the centrifugal actuator in which it is incorporated is in its starting position.
Figure 6:
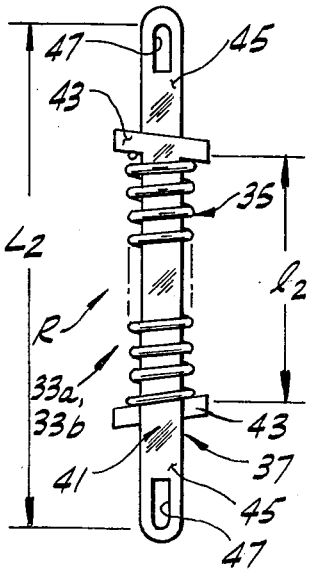
FIG. 6 is a view similar to FIG. 5 showing the improved resilient means in the position which it would assume when the centrifugal actuator is in its run position.

With ears 39 of opposed levers 17 received in openings 47 of the T-shaped elements 41 at the opposite ends of a respective spring 35, outward movement of the levers from their starting to their run positions causes the T-shaped members 41 to move apart relative to one another and to compress spring 35 between the respective heads 43 of the T-shaped elements. As shown in FIGS. 1 and 5, the distance between ears 39 of lever 17 is indicated by $L_1$ when the levers are in their starting positions. Upon movement of the levers to their outward run positions, ears 39 move apart from one another and the distance between them is indicated by $L_2$ (see FIGS. 2 and 6). Concomitantly with the increase in distance between ears 39, heads 43 of the T-shaped elements 41 move toward one another thereby to compress spring 35 from its initial length $l_1$ when the centrifugal actuator is in its starting position to a shorter length $l_2$ when the centrifugal actuator is in its run position. When compressed, springs 35 exert a biasing force on levers 17 via their respective linkages 37 so as to bias the levers inwardly toward their respective starting positions against the centrifugal force exerted on the levers rotating with shaft 3. This in turn biases starting switch actuating flange 13 toward its starting position as shown in FIG. 1.

Figure 7:
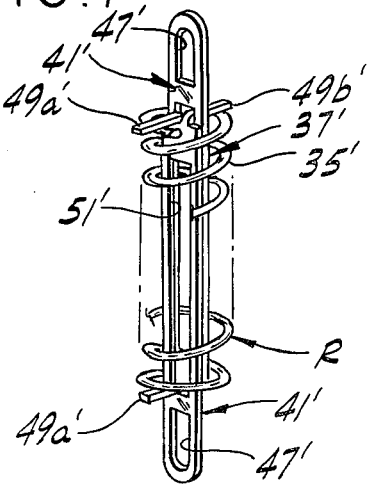
FIG. 7 is a perspective view of another embodiment of the resilient means.

A different embodiment of the compression linkage is shown in FIG. 7 and is indicated generally at 37'. This modified linkage includes a pair of identical linkage or elements 41' each having a pair of feet **49*a'*, 49*b'* which may be selectively bent outwardly. Initially these feet lie in the plane of elements 41'. Each element 41' further has an opening 47 in its end opposite its bendable feet and an elongate opening 51 in its shank. Each element 41 is inserted into the central opening of its respective spring 35 with openings 47' at opposite ends of the spring. When so inserted, feet 49*a'*, 49*b'* may be selectively bent so that one of the feet projects outwardly in one direction so as to engage one end turn to spring 35' and so that the other foot extends outwardly in the opposite direction through an opening 51' of the other element 41' so as to engage the adjacent end turn of the spring. In addition to requiring less material to manufactures than elements 41 heretofore disclosed, elements 41' are interlocked to one another by means of the outwardly extending feet 49*a'*, 49*b'* which extends through the longitudinal openings 51' in each of the elements thereby to prevent the inadvertent removal of the elements from the spring prior to installation on levers 17**.

It will be noted that by replacing the hook end extension springs of prior art centrifugal actuators with the compression coil springs of the present invention, failures due to stress concentration factors in the hook end extension springs are eliminated. It will further be noted that even with the additional cost of linkages 37 or 37', the cost of installing the resilient means 15 compares favorably with the cost of the prior extension springs due to the lower cost of the plain end compression springs. It still further be noted that the resilient means of the present invention are as easy to install in the centrifugal actuator assembly as were the prior hook-end extension springs. Also, compression coil springs are linearly compressed as levers 17 move from their starting to their run positions. Moreover, it will be understood that in the unlikely event that one of the springs 35 should break, the pieces of the spring are retained in place on the linkages 37 and thus damage to the motor is prevented.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. In an electric motor having a starting winding, a starting switch for energizing and deenergizing the starting winding, a rotor shaft, and a centrifugal actuator for actuation of said starting switch, said centrifugal actuator being rotatable with said rotor shaft, said centrifugal actuator having a pair of movable members disposed on opposite sides of said rotor shaft centrifugally responsive to the rotational speed of the shaft for moving outwardly from a starting position to a run position upon rotation of said rotor shaft at a predetermined operational speed, means for resiliently biasing said movable members toward their starting position, said movable members being movable from their run to their starting positions upon said shaft slowing down from said predetermined speed, said centrifugal actuator being adapted to be operatively interconnected to said starting switch so as to effect opening and closing thereof as said centrifugal actuator moves between its starting and its run position, wherein the improvement comprises: said centrifugal actuator biasing means including a pair of compression coil springs, a pair of linkages, one for each of said springs, each said linkage interconnecting a respective said spring between said movable members, each of said linkages comprising a first element engageable with one end of its respective compression coil spring and with the movable member opposite said one end of said compression spring and a second element engageable with the other end of said compression coil spring and with the other movable member so that movement of said movable members from their starting to their run positions causes said first and second elements to move relative to one another and causes said spring to be resiliently compressed.

2. In an electric motor as set forth in claim 1 wherein said first and second elements constituting one of said linkages are in overlapping sliding relation with one another and portions of said first and second elements are disposed within a respective compression coil spring so as to move substantially axially with respect to said spring upon movement of said movable members between their run and starting positions.

3. In an electric motor as set forth in claim 2 wherein said first and second elements each have at least one bendable portion at one end thereof, said first and second elements being inserted in opposite directions in said spring, said bendable portions being bendable outwardly so as to be engageable with opposite ends of the spring.

4. In an electric motor as set forth in claim 3 wherein said first and second elements each have an opening therethrough, said bendable portion of said first element extending through said opening of said second element and said bendable portion of said second element extending through said opening of said first element when said bendable portions are bent outwardly thereby interlocking said first and second elements to one another within their respective spring.

5. In an electric motor as set forth in claim 2 wherein each of said elements is T-shaped having a head engageable with one end of a respective compression coil spring and a shank disposed within the opening of its compression coil spring.

6. A centrifugal actuator assembly adapted to be rotatably mounted on the rotor shaft of an electric motor for energization and de-energization of a motor starting winding in response to startup and stopping of the motor, said centrifugal actuator assembly having a longitudinal axis about which it is rotated and a pair of levers disposed on opposite sides of said axis centrifugally responsive to the rotational speed of said centrifugal actuator assembly for moving outwardly from a starting position to a run position upon acceleration of said centrifugal actuator to a predetermined rotational speed, means for biasing said levers toward their starting position, said levers being movable from their run to their starting positions upon said centrifugal actuator slowing down, said biasing means comprising a pair of linkages interconnecting said levers, each of said linkages including a compression coil spring and a pair of elements including a first element engageable with one end of said compression coil spring and with the lever opposite said one end of said spring and a second element engageable with the other end of said spring and with the lever opposite said other end of said spring so that as said levers move from their starting to their run positions said elements move opposite to one another and resiliently compress their respective said compression coil spring.

* * * * *

UNITED STATES PATENT AND TRADEMARK OFFICE

CERTIFICATE OF CORRECTION

PATENT NO. : 4,242,607

DATED : December 30, 1980

INVENTOR(S) : Eugene F. Hildebrandt et al

It is certified that error appears in the above-identified patent and that said Letters Patent are hereby corrected as shown below:

Column 3, line 29, delete "members".

Column 3, line 39, "postion" should be "position".

Column 4, line 68, "$l_1$" should be -- $l_2$ --.

Column 5, line 48, "linkage or" should be "linkage members or".

Signed and Sealed this

*Twenty-second* Day of *September 1981*

[SEAL]

*Attest:*

GERALD J. MOSSINGHOFF

*Attesting Officer*

*Commissioner of Patents and Trademarks*